United States Patent [19]

Oyama

[11] 4,130,919

[45] Dec. 26, 1978

[54] APPARATUS FOR REMOVING A SHADOW MASK ASSEMBLY FROM A PANEL AND INSERTING SAME INTO A DUMMY PANEL

[75] Inventor: Tadao Oyama, Mobara, Japan

[73] Assignee: Hitachi, Ltd., Japan

[21] Appl. No.: 819,619

[22] Filed: Jul. 27, 1977

[30] Foreign Application Priority Data

Aug. 11, 1976 [JP] Japan ..... 51-94898

[51] Int. Cl.[2] ..... H01J 9/00

[52] U.S. Cl. ..... 29/25.19; 29/25.11

[58] Field of Search ..... 29/25.19, 25.2, 25.15, 29/25.13, 25.11

[56] References Cited

U.S. PATENT DOCUMENTS 3,724,740 4/1973 Imamura ..... 29/25.19

*Primary Examiner*—Richard B. Lazarus

*Attorney, Agent, or Firm*—Craig & Antonelli

[57] ABSTRACT

Apparatus for removing a shadow mask assembly from a panel and inserting same into a dummy panel. The apparatus includes panel rests for placing thereon the panel supporting the shadow mask assembly, positioning pawls adapted to engage the inner lateral surfaces of the panel for positioning the panel in a predetermined position on the panel rests, pushers cooperating with the positioning pawls for holding side walls of the panel after the latter has been positioned in the predetermined position and a mask holder operative to move into the interior of the panel from below to release the engagement between the panel and shadow mask assembly and to support the shadow mask assembly and to move same downwardly. The panel rests have attached to their surfaces pins for positioning in a predetermined position a dummy panel placed thereon, and the mask holder has connected thereto a cylinder for moving upwardly the shadow mask assembly to a position in which the shadow mask assembly supported on the mask holder can be transferred to the dummy panel or the panel rests.

6 Claims, 12 Drawing Figures

APPARATUS FOR REMOVING A SHADOW MASK ASSEMBLY FROM A PANEL AND INSERTING SAME INTO A DUMMY PANEL

LIST OF PRIOR ART REFERENCES (37 CFR 1.56 (a))

The following references are cited to show the state of the art:

Japanese Patent Appln. Laid-Open No. 87275/74

U.S. Pat. No. 3,838,483.

This invention relates to apparatus for use in a color television cathode-ray tube production line for removing a shadow mask assembly from a panel mounted at the front surface of a color television cathode-ray tube and inserting the removed shadow mask assembly into a dummy panel.

Generally, in producing color television cathode-ray tubes, it is necessary to perform a series of exposing operations by mounting a shadow mask assembly in a predetermined position within a panel. A phosphor containing photosensitive or resist material is coated on an inner surface of a panel of a cathode-ray tube, selected areas of the coating are exposed to a light source to permanently affix the phosphor contained in the light exposed material to the inner surface of the panel, and unexposed portions of the coating are removed from the panel. The aforesaid steps are repeated permanently to affix red, green and blue light emitting phosphors to the inner surface of the panel in a desired repetitive pattern such as the triad dot or stripe pattern. To perform these operation steps, it is necessary to attach the shadow mask assembly within the panel and detach same therefrom. Also, the shadow mask assembly detached from the panel should be inserted in a dummy panel for storage or transportation purposes. Heretofore, it has been usual practice to perform these operation steps manually, and the operation has consequently been very low in efficiency. One example of the apparatus for removing a shadow mask assembly from a panel is disclosed in Japanese Laid-Open Patent Application No. 87257/74. This apparatus is intended merely to perform by mechanical means the step of withdrawing a shadow mask assembly from a panel, and is not designed to automatically insert the removed shadow mask assembly into a dummy panel.

Accordingly, this invention has as its object the provision of an apparatus which is capable of receiving a shadow mask assembly containing panel delivered thereto, withdrawing a shadow mask assembly from the panel and then inserting the shadow mask assembly into a dummy panel to be supported therein.

According to the invention, there is provided an apparatus for removing from a panel a shadow mask assembly supported within said panel and for inserting said shadow mask assembly into a dummy panel, said shadow mask assembly having secured to its outer lateral surfaces resilient plates each having a free end and formed in the vicinity of the free end with a hole, and said panel and said dummy panel each having secured to its inner lateral surfaces pins projecting inwardly for engagement in the respective holes formed in the shadow mask assembly, such apparatus comprising, in combination, means for supporting said panel at a lower end thereof in a manner to permit the panel to move substantially horizontally, said means including a space large enough to permit the shadow mask assembly to move downwardly therethrough after the shadow mask assembly is removed from the panel; means operative to come into engagement with inner and outer surfaces of side walls of the panel to position the panel in a shadow mask assembly removing position and hold same in said position on said support means; shadow mask assembly removing means operative to remove the shadow mask assembly from the panel including a mask support plate, means mounted on said mask support plate for bending the resilient plates of the shadow mask assembly in a manner to release said plates from engagement with the pins of the panel, and a first driving means for moving said panel support plate in reciprocatory movement between a first position in which the shadow mask assembly in the panel is removed therefrom and a second position located beneath said first position; means for positioning said dummy panel on said means for supporting said panel; four support members mounted on said mask support plate and each having a support surface for supporting the underside of one of four corners of the shadow mask assembly and a guide surface for guiding an outer lateral surface of one of the four corners of the shadow mask assembly in such a manner that the shadow mask assembly is positioned on said mask support plate; and a second driving means for moving said mask support plate to a third position in which the shadow mask assembly supported by said four support members is positioned vertically with respect to said dummy panel.

Before giving a detailed description of the embodiment of the invention, the construction of the panel, shadow mask assembly and dummy panel handled by the apparatus in conformity with one embodiment of the invention will be described. These parts are all known.

Figure 1:
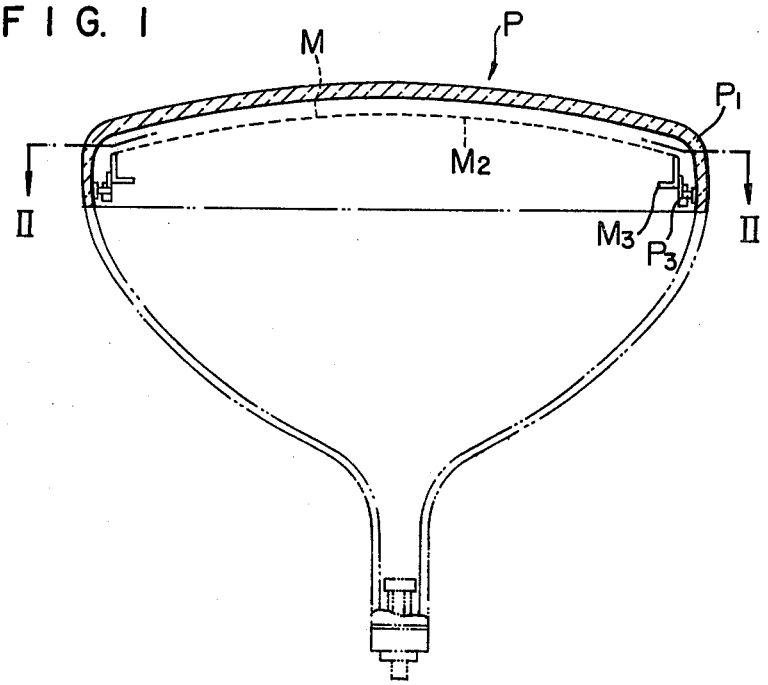
FIG. 1 is a sectional view showing the manner in which a panel and a shadow mask assembly are assembled.
Figure 2:
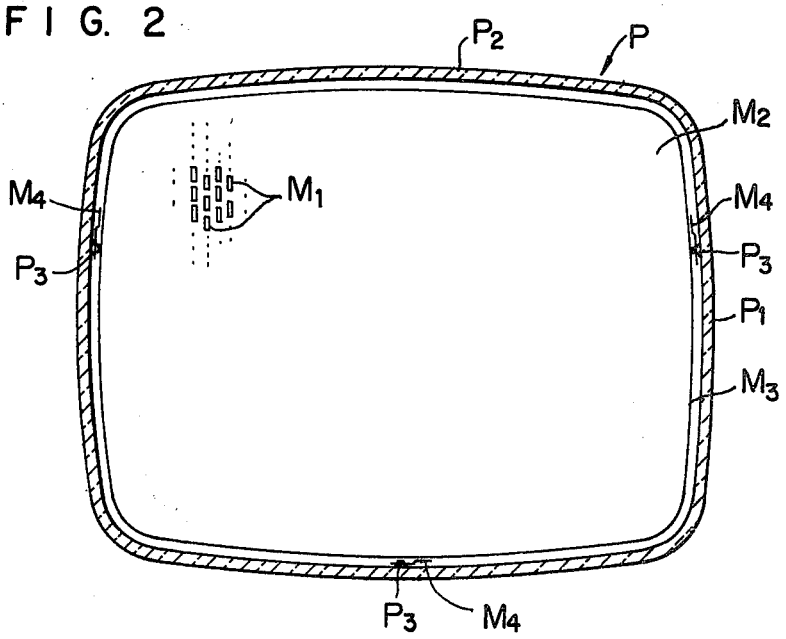
FIG. 2 is a sectional view as seen in the direction of arrows II—II of FIG. 1.

Referring to FIGS. 1 and 2, the panel P has a skirt including side walls $P_1$ and $P_2$, and three pins $P_3$ each secured at a predetermined position to an inner surface of one of the side walls for supporting the shadow mask assembly M within the panel P. The shadow mask assembly M includes a mask member $M_2$ of a predetermined shape formed therein with a multitude of apertures of a predetermined shape, such as circular or rectangular, a frame $M_3$ of a substantially rectangular shape for supporting the mask member $M_2$, and three engaging members $M_4$ each secured in a predetermined position to an outer lateral surface of the frame $M_2$, each engaging member $M_4$ comprising a resilient plate secured to the frame in a manner to have a free end and formed therein with a hole for receiving the respective pin of the panel in engaging relation.

Figure 3:
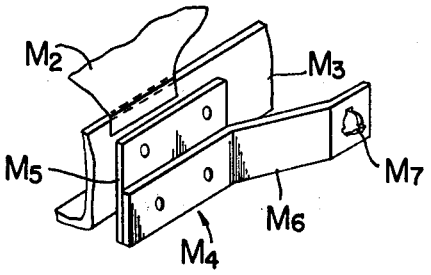
FIG. 3 is a perspective view showing one example of the engaging members secured to the shadow mask assembly.

One example of the engaging members $M_4$ is shown in FIG. 3 in which the engaging member $M_4$ comprises a bimetal member $M_5$ joined to the outer lateral surface of the frame $M_3$ as by spot welding, and a resilient plate $M_6$ joined at one end portion thereof in a predetermined position to the bimetal member $M_5$ as by spot welding and having a free end portion which is formed therein with an engaging hole $M_7$ for receiving therein the respective pin of the panel in engaging relationship.

Figure 4:
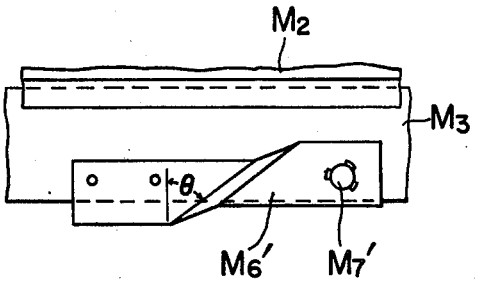
FIG. 4 is a side view showing another example of the engaging members different from the example shown in FIG. 3.

FIG. 4 shows another form of engaging member in which a resilient plate $M'_6$ of a predetermined shape is secured in a predetermined portion to the frame $M_3$ in a manner to have a free end at one end thereof, with the resilient plate $M'_6$ being formed near its free end with an engaging hole $M'_7$ for receiving the respective pin in engaging relationship.

Figure 5:
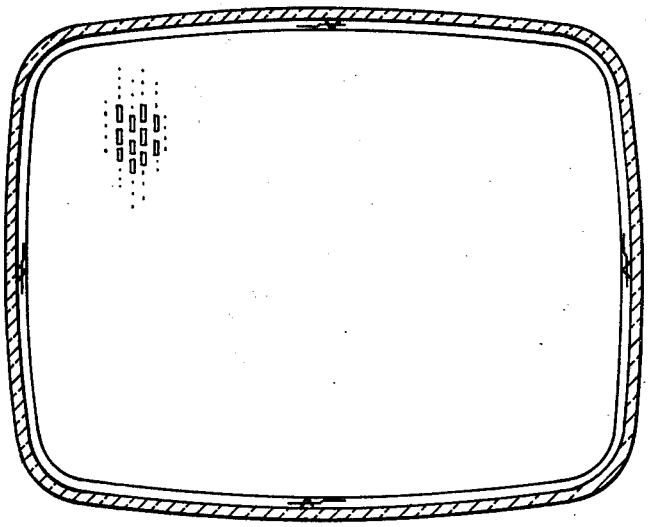
FIG. 5 is a view similar to FIG. 2 but showing an assembly of a panel and a shadow mask assembly different from those shown in FIGS. 1 and 2.

FIG. 5 shows a panel having four pins and a shadow mask assembly having four engaging members corresponding to the four pins on the panel. Such panel and shadow mask assembly can also be handled by the apparatus according to the invention.

In short, the shadow mask assemblies that can be handled by the apparatus according to the invention comprise a mask member, a frame for supporting the mask member, and a plurality of engaging members (generally three or four in number) each secured in a predetermined position to the outer lateral surfaces of the frame, each engaging member comprising a resilient plate secured at one end portion thereof to the frame and having a free end portion formed therein with a hole for receiving one of the pins on the panel in engaging relationship. Such shadow mask assemblies are of the type which can be mounted in and removed from the panel by merely bending the resilient plates. The shadow mask assemblies of this type include the examples shown in FIGS. 1 to 5. The shadow mask assemblies that can be handled by the apparatus according to the invention also include those disclosed in U.S. Pat. Nos. 3,330,980, 3,754,157 and 3,803,436, for example.

Figure 6:
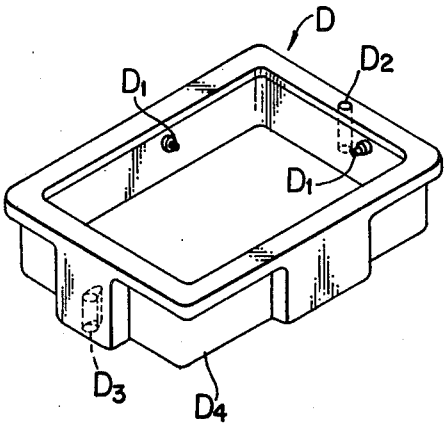
FIG. 6 is a perspective view of one form of dummy panel.
Figure 7:
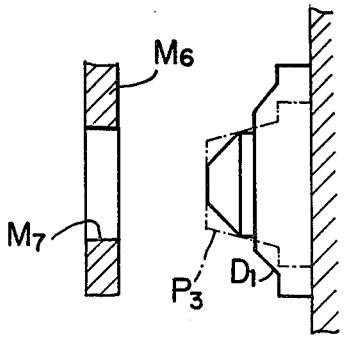
FIG. 7 is a view showing the pins of the panel and the dummy panel and a hole of the engaging member.
Figure 8:
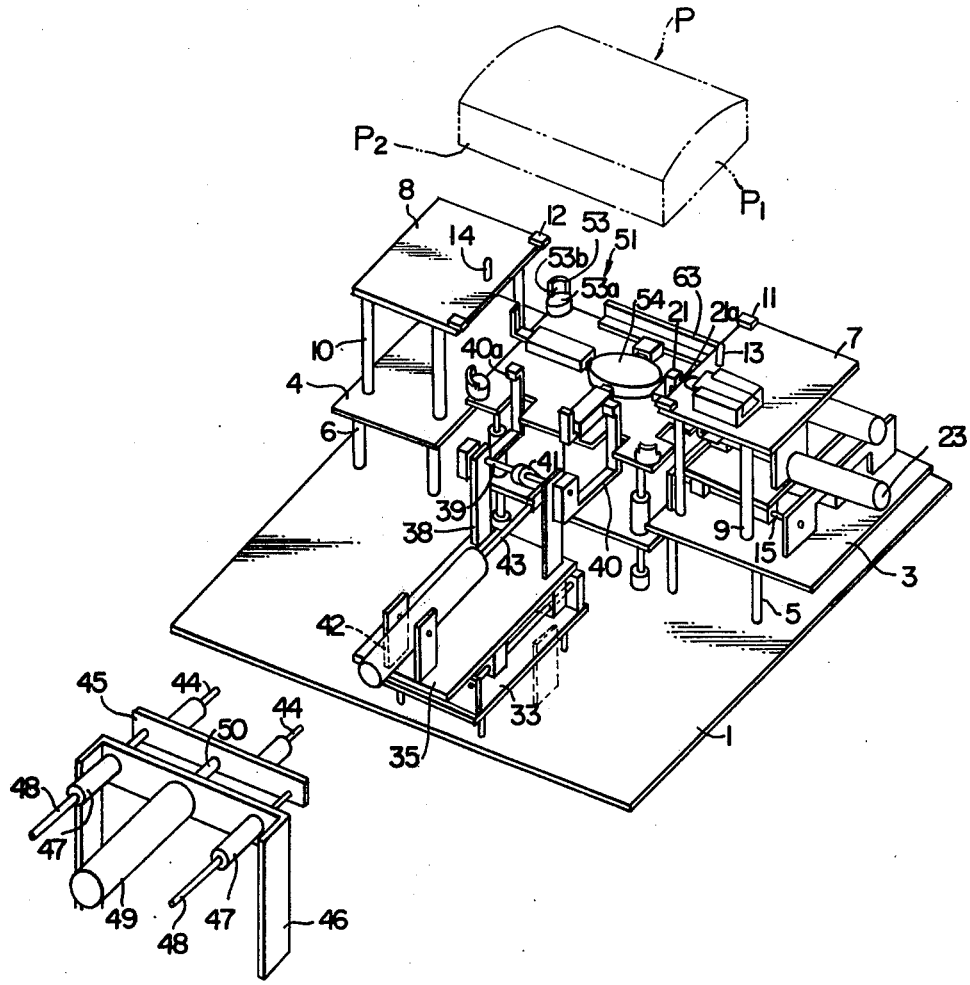
FIG. 8 is a schematic perspective view of one embodiment of the present invention.

Now, a dummy panel D used for storing the shadow mask assembly M has, as shown in FIG. 6, secured to its inner lateral surfaces a plurality of pins $D_1$ each being located in a position corresponding to the position of one of the engaging holes $M_7$ of the shadow mask assembly M. The dummy panel D is also formed in opposite side walls with a reference hole $D_2$ opening in a lower end edge $D_4$ of the dummy panel D and a slot $D_3$ also opening in the lower end edge $D_4$. The reference hole $D_2$ and slot $D_3$, which are used for positioning the dummy panel D in a horizontal plane, are precisely finished. The lower end edge $D_4$ of the dummy panel D is accurately and precisely finished so that it can serve as a reference surface for positioning the pins $D_1$ in the vertical direction. As shown in FIG. 7, each pin $D_1$ of the dummy panel D has a forward end which is considerably smaller in size than the forward end of each pin $P_3$ of the panel P. This difference in size between the pins $D_1$ and pins $P_3$ makes it possible to readily bring the pins $D_1$ into engagement in the engaging holes $M_7$ of the shadow mask assembly even if there are errors in the alignment of the pins $D_1$ with the engaging holes $M_7$.

The embodiment of the invention illustrated in FIGS. 8 to 12 will now be described. The illustrated apparatus is adapted for handling the panel having three pins and the shadow mask assembly having three engaging members shown by way of illustration in FIGS. 1 and 2.

Referring to FIGS. 8 to 11, the numeral 1 designates a base secured to the floor through a frame 2. A plurality of support plates 3 and 4 are mounted in predetermined spaced relation through support posts 5, 5 and 6, 6 respectively on the base 1. Mounted respectively on the support plate 3 and 4 through support posts 9, 9 and 10, 10 are panel rests 7 and 8 which include lateral marginal portions facing each other and having on opposite ends of each lateral marginal portion pads 11, 11 and 12, 12 made of rubber or other resilient material for supporting thereon lower edges of shorter side walls $P_1$ of a substantially rectangular panel P conveyed by conveyor means (not shown). The panel rests 7 and 8 are spaced from each other a distance large enough to provide a space for moving downwardly therethrough a shadow mask assembly M by means of a mask holder subsequently to be described from the panel resting on the panel rests 7 and 8. Located near the edges of the panel rests 7 and 8 facing each other and substantially midway between the pads 11 and 11 and 12 and 12 are guide pins 13 and 14 respectively which are used for positioning a dummy panel D which has been described above. The guide pins 13 and 14 are arranged such that they are positioned outside the respective shorter side walls $P_1$ of the panel P placed on the pads 11, 11 and 12, 12. In the following description, the longitudinal direction of the panel P placed on the pads 11, 11 and 12, 12 will be referred to as an X-direction and a direction at a right angle thereto will be referred to as a Y-direction (See FIG. 9).

Mounted horizontally on the support plate 3 and extending in the X-direction are two guide rods 15, 15 slidably supporting thereon a sliding plate 16 connected to a forward end of a piston rod 18 of a pneumatic cylinder 17 secured to the support plate 3. Thus the sliding plate 16 can be moved in reciprocatory motion in the X-direction by the pneumatic cylinder 17. The sliding plate 16, supports thereon a support post 19 and a bracket 20. The support post 19 pivotally supports at the pivot 22 a positioning pawl 21 of substantially L-shape having at its forward end an engaging surface 21*a* adapted to come into engagement with an inner surface of a shorter side wall of the panel P, while the bracket 20 pivotally supports a pneumatic cylinder 23 having a piston rod 24 connected to a lever 25 which in turn is connected to the positioning pawl 21, so that the pneumatic cylinder 23 can move the positioning pawl 21 about the pivot 22. The position in which the pneumatic cylinder 23 is mounted and the stroke of the pneumatic cylinder 23 are determined such that the engaging surface 21*a* at the forward end of the positioning pawl 21 can move between a positioning or operative position (the position shown in FIG. 10) in which the engaging surface 21*a* is maintained in engagement with the inner surface of the shorter side wall of the panel P within the panel P and a lower position to which the positioning pawl 2 is moved pivotally to stay out of the way of the downward movement of the shadow mask assembly M from the panel. A suitable stopper may be used for causing the positioning pawl 21 to stop positively in the operative position. Meanwhile the position in which the pneumatic cylinder 17 for driving the sliding plate 16 and the stroke of the pneumatic cylinder 17 are determined such that the sliding plate 16 can move between a forward position in which the forward end of the positioning pawl 21 is introduced into the panel P when the positioning pawl 21 is pivotally moved from its lower position to its operative position and a rearward or operative position in which the pawl 21 in its operative position comes into engagement with the inner surface of the side wall of the panel P for accurately positioning the panel in the X-direction. A suitable stopper may be used for causing the sliding plate 16 to stop positively in the operative position.

Mounted on an upper surface of the panel rest 7 and located in spaced juxtaposed relation to the engaging surface 21*a* of the positioning pawl 21 is a pusher 26 which is movably supported by a guide 27 fixedly secured to the panel rest 7 and which has a lever 29 extending downwardly through a slot 28 (See FIG. 12) formed in the panel rest 7. The panel rest 7 has secured to its underside through a bracket 30 a pneumatic cylinder 31 having a piston rod 32 connected to the lever 29. Thus the pneumatic cylinder 31 drives the pusher 26 in such a manner that the latter will cooperate with the positioning pawl 21 to hold the side wall of the panel P therebetween to hold the panel in position.

A third support plate 33 is mounted in a position which is substantially midway between the panel rests 7 and 8 and is slightly removed from a line connecting side edges of the panel rests 7 and 8. Mounted on the support plate 33 and extending horizontally in the Y-direction are two guide rods 34, 34 which slidably support a sliding plate 35. As can be clearly seen in FIG. 11, the sliding plate 35 is connected to a piston rod 37 of a pneumatic cylinder 36 mounted on the support plate 33 and adapted to move between a forward position and a rearward or operative position like the sliding plate 16. The sliding plate 35 has two upstanding posts 38, 38 secured thereto for rotatably supporting a shaft 39 at upper ends thereof. An L-shaped positioning pawl 40 is secured to either end of the shaft 39, and a lever 41 is secured to the center of the shaft 39. A pneumatic cylinder 42 is pivotally supported on the sliding plate 35 and has a piston rod 43 which is connected at its forward end to the lever 41. By this arrangement, the positioning pawls 40, 40 can be moved between a positioning or operative position shown in FIG. 11 and a lower position. Pushers 44, 44 are arranged in spaced juxtaposed relation to engaging surfaces 40*a*, 40*a* of the positioning pawls 40, 40 which come into engagement with an inner surface of a side wall $P_2$ of the panel P. The pushers 44, 44 are secured to a bar 45 supported by rods 48, 48 each extending through a sleeve 47 secured to a bracket 46 which in turn is secured to the base 1. Secured to the bracket 46 is a pneumatic cylinder 49 having a piston rod 50 which is connected to the bar 45 for driving the same.

A mask holder 51 is arranged in a space defined by the support plates 3, 4 and 33. The mask holder 51 includes a horizontal mask support plate 52 which has support members 53 located on four corners of its upper surface. the support members 53 each include a horizontal support surface 53*a* for supporting one of four corners of a shadow mask assembly M and a vertical guide surface 53*b* for guiding the outer side surface of one of the four corners thereof. Additionally, the support plate 52 has mounted thereon a rotary groove cam 54, four sliders 55, 56, 57 and 58 each being maintained at one end in engagement with the groove cam 54 and guides 59, 60, 61 and 62 each supporting one of the sliders 55, 56, 57 and 58 for sliding movement. The slider 55 has mounted at the other end thereof an engaging pawl 63 of a large width which is adapted to come into engagement with an outer surface of a longer side wall of the shadow mask assembly M. The sliders 56, 57 and 58 have mounted at the other end thereof engaging pawls 56*a*, 57*a* and 58*a* respectively which are adapted to come into engagement with resilient plates $M_6$ mounted on the other longer side wall and two shorter side walls of the shadow mask assembly M to bend the same toward the shadow mask assembly M. The groove cam 54 are shaped such that when it rotates in one direction all the sliders 55, 56, 57 and 58 move radially outwardly and when it rotates in the opposite direction all the sliders move radially inwardly. A torque actuator 64 (See FIG. 11) for rotating the groove cam 54 is mounted on the underside of the mask support plate 52.

Figure 10:
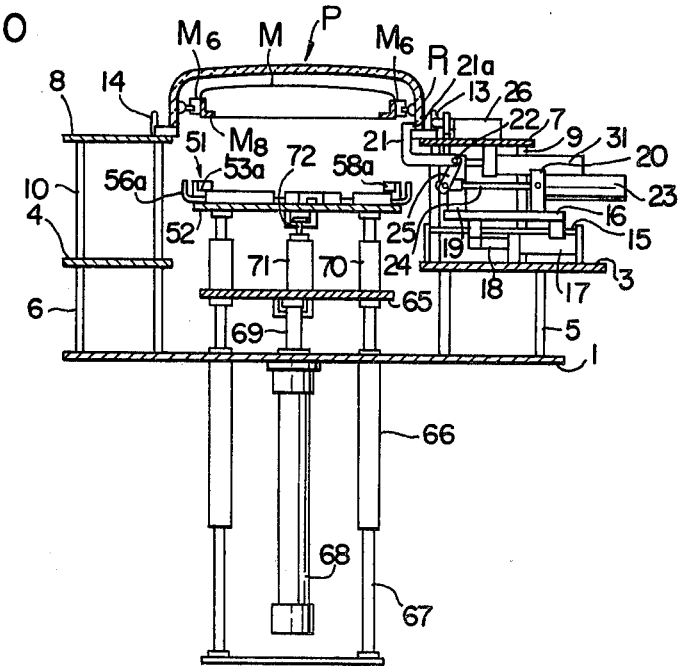
FIG. 10 is a view as seen in the direction of arrows X—X of FIG. 9.
Figure 11:
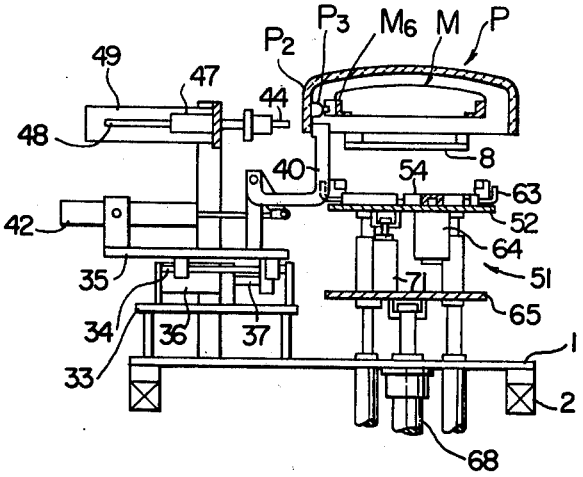
FIG. 11 is a view as seen in the direction of arrows XI—XI of FIG. 9.
Figure 12:
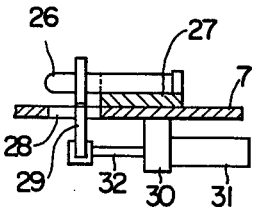
FIG. 12 is a view as seen in the direction of arrows XII—XII of FIG. 9.

Mounted between the mask support plate 52 and the base 1 is a horizontal elevatory plate 65 which is fixed to sleeves 70, 70 slidably receiving rods 67, 67 which are also slidably fitted in sleeves 66, 66 vertically secured to the underside of the base 1, and which is connected at its underside to an upper end of a piston rod 69 of a pneumatic cylinder 68 secured to the base 1. A pneumatic cylinder 71 is mounted on an upper surface of the elevatory plate 65, and the mask support plate 52 is secured at its underside to upper ends of rods 67, 67 extending through the sleeves 70, 70 and connected to an upper end of a piston rod 72 of the pneumatic cylinder 71. Thus the mask support plate 52 and elevatory plate 65 can be simultaneously moved upwardly and downwardly by means of pneumatic cylinder 68, and the spacing between the mask support plate 52 and elevatory plate 65 can be varied by means of pneumatic cylinder 71. The positions in which pneumatic cylinders 68 and 71 are mounted and their strokes are determined such that when the pistons 69 and 73 of pneumatic cylinders 68 and 71 respectively are withdrawn into the respective cylinders the mask support plate 52 is disposed in a position in which it is spaced downwardly from the panel P as shown in FIG. 10, that when only the piston 69 is extended from its pneumatic cylinder 68 the mask support plate 52 moves into the panel and occupies a position in which the mask support plate 52 is adapted to remove the shadow mask assembly M from the panel P, and that when both pistons 69 and 73 are extended from the pneumatic cylinders 68 and 71 respectively the mask support plate 52 moves to a position in which the mask support plate 52 is adapted to mount, within a dummy panel (not shown) supported on the panel rests 7 and 8, the shadow mask assembly M which is supported on the support members 53, 53 on the mask support plate 52.

Figure 9:
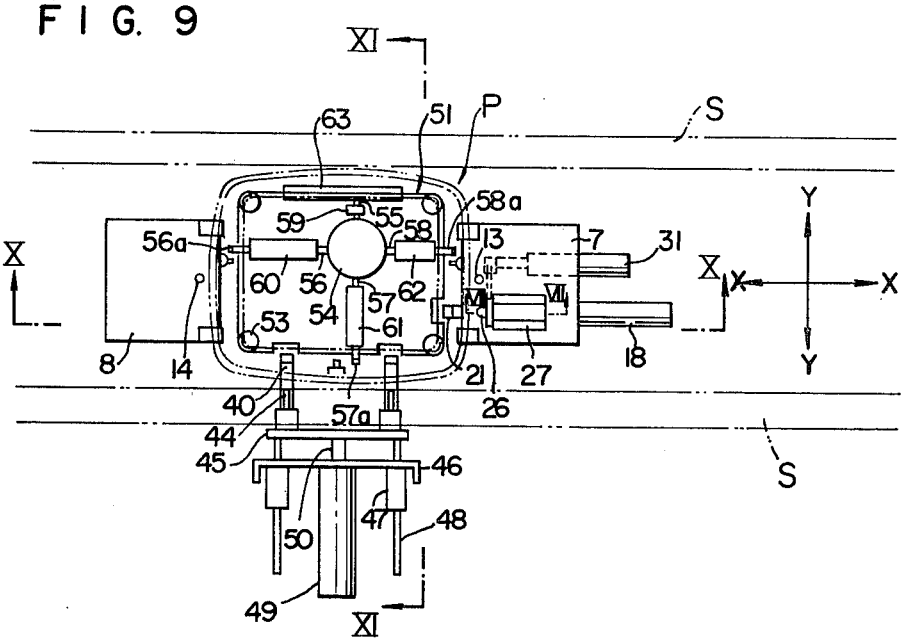
FIG. 9 is a top plan view of the embodiment shown in FIG. 8.

The apparatus constructed as aforesaid is arranged as one of a series of apparatus located along an automatic color picture production line, and is interposed between two shuttle conveyors S as shown in FIG. 9 in a concrete embodiment. There is also provided conventional conveyor means (not shown) for transferring a panel from the shuttle conveyors S to the pads 11 and 12 on the panel rests 7 and 8 and for transferring the panel on the panel rests 7 and 8 back to the shuttle conveyors S. The conveyor means, pneumatic cylinders and torque actuator are all connected to control means (not shown), so that the operation described hereinafter can be performed automatically.

The operation of the apparatus constructed as aforesaid will now be described. A panel P supporting therein a shadow mask assembly M is conveyed by the shuttle conveyors S to a position near the apparatus. The shadow mask assembly M is supported within the panel P by means of the panel pins $P_3$ received in the holes $M_7$ formed in the resilient plates $M_6$ as shown in FIGS. 1 and 2. The panel P on the shuttle conveyors S is transferred to and placed on the pads 11 and 12 on the panel rests 7 and 8 by conveyor means (not shown). Since the conveyor means has no function of accurately positioning the panel P in a shadow mask assembly M detaching position in which the shadow mask assembly M is to be detached from the panel P, the panel P may be placed in a position which is slightly displaced from the shadow mask assembly M detaching position. At this time, the pistons 24 and 43 of pneumatic cylinders 23 and 42 associated with the positioning pawls 21 and 40 respectively are withdrawn into their respective cylinders, so that the positioning pawls 21 and 40 are in their lower positions. The piston rods 32 and 50 of pneumatic cylinders 31 and 49 associated with the pushers 26 and 44 respectively are also withdrawn into their respective cylinders. The piston rods 18 and 37 of pneumatic cylinders 17 and 36 associated with the sliding plates 16 and 35 respectively are extended from their respective cylinders, so that the sliding plates 16 and 35 are in their forward positions. The piston rods 69 and 72 of pneumatic cylinders 68 and 71 respectively associated with the mask holder 51 are withdrawn into their respective cylinders, so that the mask support plate 52 is in its lowermost position.

With the parts in the aforesaid positions pneumatic cylinders 23 and 42 are first actuated to move upwardly the positioning pawls 21 and 40 from their lower positions to their positioning or operative positions. Since the sliding plates 16 and 35 are in their forward positions at this time, the forward ends of positioning pawls 21 and 40 are introduced into the panel P. The pneumatic cylinders 17 and 36 are actuated to move the sliding plates 16 and 35 rearwardly. The rearward movement of the sliding plates 16 and 35 brings the engaging surfaces 21*a* and 40*a* at the forward ends of the positioning pawls 21 and 40 into engagement with the inner surfaces of the side walls of the panel P, so that the panel P is moved in sliding motion on the pads 11 and 12. After the sliding plates 16 and 35 have moved rearwardly to their positioning or operative positions and have stopped therein, pneumatic cylinders 31 and 49 are actuated to move the respective pushers 26 and 44 forwardly into pressing engagement with outer surfaces of the side walls of the panel P. Thus the side walls $P_1$ and $P_2$ are held between the positioning pawls and the pushers and accurately positioned in a position which is determined by the positions of the engaging surfaces 21*a* and 40*a* of the positioning pawls 21 and 40, with the inner surfaces of the side walls of the panel P serving as reference surfaces. Stated differently, the panel P is accurately positioned with respect to both the X-direction and Y-direction in FIG. 9.

The pneumatic cylinder 68 is actuated to move the elevatory plate 65 and mask support plate 52 upwardly, with the mask support plate 52 stopping in a position in which the support surfaces 53*a* of the support members 53 on the plate 52 are slightly below the lower end edge $M_8$ of the shadow mask assembly M supported by the panel P and stops in a position in which the outer lateral surfaces of the corners of the shadow mask assembly M are in engagement with the inner sides of the support surfaces 53*b*. At this time, the sliders 55, 56, 57 and 58 on the mask support plate 52 are in radially expanded positions, and the engaging pawls 56*a*, 57*a* and 58*a* are inserted between the inner surfaces of the side walls of the panel P and the resilient plates $M_6$ attached to the side walls of the shadow mask assembly M as the mask support plate 52 moves upwardly. Thereafter the torque actuator 64 is actuated to move the sliders radially inwardly. As the sliders move radially inwardly, the engaging pawls 56*a*, 57*a* and 58*a* press the plate springs $M_1$ inwardly toward the respective side walls of the shadow mask assembly M, thereby releasing the resilient plates $M_1$ from engagement with the panel pins $P_3$. As a result, the shadow mask assembly M is supported by the engaging pawls 56*a*, 57*a*, 58*a* and 63 on the mask support plate 52. Then pushers 24 and 44 and positioning pawls 21 and 40 are restored to their original positions, and piston rod 69 is withdrawn into pneumatic cylinders 68 to move the elevatory plate 65 and mask support plate 52 to their original positions, so that the shadow mask assembly M is detached from the panel P. The panel P is transferred by the conveyor means to the shuttle conveyors S and conveyed by the latter to the next processing station.

The shadow mask assembly M detached from the panel P is mounted in the dummy panel D shown in FIG. 6. Like the panel P, the dummy panel D has attached to inner surfaces of its side walls pins $D_1$ which correspond in position to the openings $M_9$ of the respective resilient plates $M_6$ on the lateral surfaces of the shadow mask M. The dummy panel D further has a reference hole $D_2$ and a slot $D_3$ formed in the opposite shorter walls for receiving therein the guide pins 13 and 14 attached to the panel rests 7 and 8 respectively. When the dummy panel D is placed on the panel rests 7 and 8 in such a manner that the pins 13 and 14 are inserted in the reference hole $D_2$ and slot $D_3$ respectively, the positions of the pins $D_1$ of the dummy panel D in a horizontal plane coincide with the positions of the holes $M_7$ formed in the resilient plates $M_6$ of the shadow mask assembly M in the same horizontal plane.

First, the dummy panel D is placed on the panel rests 7 and 8 with the guide pins 13 and 14 being inserted in the reference hole $D_2$ and the slot $D_3$ respectively. Meanwhile the torque actuator 64 of the mask holder 51 is actuated to move the engaging pawls 56*a*, 57*a*, 58*a* and 63 outwardly to release the shadow mask assembly M from the engaging pawls. Thus the shadow mask assembly M is positioned horizontally by the guide surfaces 53*b* of the support members 53 and placed on the support surfaces 53*a* of the support members 53 on the mask support plate 52. Then the torque actuator 64 is actuated again to move the engaging pawls 56*a*, 57*a*, 58*a* and 63 inwardly so as to bend the resilient plate $M_6$ toward the respective side walls of the shadow mask assembly M. This operation is performed to keep constant the height of the holes $M_7$ in the resilient plates $M_6$ of the shadow mask assembly M by using the support surfaces 53*a* of the support members 53 as references, irrespective of possible variations in the spacing between the lower end edge of the panel P and the axes of the panel pins $P_3$. Then pneumatic cylinder 68 is actuated to move the elevatory plate 65 and mask support plate 52. At the same time, pneumatic cylinder 71 is actuated to move the mask support plate 52 further upwardly relative to the elevatory plate 65 until the plate 52 reaches its uppermost position in which the positions in vertical planes of the holes $M_7$ of the resilient plates $M_6$ of the shadow mask assembly M coincide with the positions in the same vertical planes of the pins $D_1$ of the dummy panel D on the panel rests 7 and 8. Accordingly, upward movement of the mask support plate 52 causes the shadow mask assembly M supported thereon to be inserted into the dummy panel D and to stop in a position in which the pins $D_1$ of the dummy panel D are aligned with the respective holes 7 in the resilient plates $M_6$ of the shadow mask assembly M. Thereafter the torque actuator 64 is actuated to move the engaging pawls 56*a*, 57*a*, 58*a* and 63 outwardly to thereby release the resilient plates $M_6$ of the shadow mask assembly M. As the resilient plates $M_6$ are released in this way, the resilient plates $M_6$ are allowed to move outwardly by their own resilience and the pins $D_1$ of the dummy panel D are inserted in the respective holes $M_7$. Then pneumatic cylinders 68 and 71 are actuated to move the elevatory plate 65 and mask support plate 52 to their lowermost positions. The dummy panel D mounting the shadow mask assembly M therein is forwarded to the next following operating station. Thus one cycle of operation of detaching a shadow mask assembly from a panel and mounting the detached shadow mask assembly in a dummy panel is completed. This cycle is repeated.

In the embodiment shown and described hereinabove, positioning of a panel is effected by means of the positioning pawls by using the inner surfaces of the side walls of the panel as references. It is to be understood that the outer surfaces of the side walls of the panel can also be used as references in effecting the positioning of the panel by means of the pushers.

In the description set forth hereinabove, reference has been made to the construction and operation of the apparatus which handles a shadow mask assembly having three engaging members. However, it will be apparent from the following description that the apparatus according to the invention can also handle a shadow mask assembly having four engaging members.

Generally, in the production of color television cathode-ray tubes, the present practice is such that three out of the four engaging members are prepared or secured beforehand to the outer surface of the side wall of the shadow mask assembly, with one engaging member initially not being secured thereto. After the shadow mask assembly has been used for affixing red, greeen and blue light emitting phosphors in the desired pattern on the inner surface of a panel by exposing the panel to a light source after coating the panel with a phosphor containing photosensitive material, the fourth engaging member or the resilient plate is secured to the shadow mask assembly at the time the shadow mask assembly is mounted in the proximity of the inner surface of the panel to provide a final product. Therefore, in the apparatus described above, it is possible to remove the shadow mask assembly from the panel by utilizing the three engaging members even if the shadow mask assembly ultimately has four engaging members when completed.

Although it will hardly be put into practice, one may think of the idea of using the aforesaid apparatus for handling a shadow mask assembly having four engaging members secured to the shadow mask assembly beforehand. If this is the case, the apparatus can be used for this purpose by replacing the engaging pawl 63 of a large width mounted at one end of the slider 55 by an engaging pawl of the same shape as the engaging pawls 56*a*, 57*a* and 58*a*, so that the new engaging pawl 63 can be brought into engagement with the fourth engaging member of the shadow mask assembly.

While the apparatus according to the invention has been described by referring to the use of the guide pins 13 and 14 as means for positioning the dummy panel of the shape shown in FIG. 6, it is to be understood that the invention is not limited to this form of positioning means or the dummy panel. The dummy panel may be shaped substantially like the panel actually used for the production of a color television cathode-ray tube (the panel handled by the apparatus according to the invention). It is case, it is necessary to pay attention to finishing, with increased precision, such parts that will serve as references for the panel, such as the lower end surface of the panel skirt and the positions of the pins. The positioning of the dummy panel of this shape in a horizontal plane may be effected by the same method as described with reference to the positioning of the panel from which the shadow mask assembly is to be removed. In this case, the guide pins 13 and 14 may be done without. To those skilled in the art to which this invention relates, many changes in means for positioning the dummy panel will suggest themselves without departing from the scope of this invention.

I claim:

1. Apparatus for removing from a panel a shadow mask assembly supported within said panel and for inserting said shadow mask assembly into a dummy panel, said shadow mask assembly having secured to its outer lateral surfaces resilient plates each having a free end and formed in the vicinity of the free end with a hole, and said panel and said dummy panel each having secured to its inner lateral surfaces pins projecting inwardly for engagement in the respective holes formed in the shadow mask assembly, such apparatus comprising, in combination:

means for supporting said panel at a lower end thereof with the panel opening facing downwardly in a manner to permit the panel to move substantially horizontally, said means including a space large enough to permit the shadow mask assembly to move downwardly therethrough after the shadow mask assembly is removed from the panel;

means operative to come into engagement with inner and outer surfaces of side walls of the panel to position the panel in a shadow mask assembly removing position and hold same in said position on said support means;

shadow mask assembly removing means operative to remove the shadow mask assembly from the panel including a mask support plate, means mounted on said mask supported plate for bending the resilient plates of the shadow mask assembly in a manner to release said plates from engagement with the pins of the panel, and a first driving means for moving said mask support plate in reciprocatory movement between a first position in which the shadow mask assembly is in the panel and is engaged by said removing means and a second position located beneath said first position wherein said mask assembly is removed from said panel;

means for positioning said dummy panel on said means for supporting said panel;

four support members mounted on said mask support plate and each having a support surface for supporting the underside of one of four corners of the shadow mask assembly and a guide surface for guiding an outer lateral surface of one of the four corners of the shadow mask assembly in such a manner that the shadow mask assembly is positioned on said mask support plate; and driving means for moving said mask support plate to a position in which the shadow mask assembly supported by said four support members is positioned within said dummy panel.

2. Apparatus as claimed in claim 1, wherein said dummy panel is formed with a reference hole and a slot opening at a lower end surface of the dummy panel, and said dummy panel positioning means comprises two pins securedly mounted on said panel support means and each adapted to be inserted in one of said reference hole and said slot.

3. Apparatus as claimed in claim 1, wherein said first driving means comprises a first cylinder means and an elevatory plate adapted to be moved upwardly and downwardly by said first cylinder means, and said second driving means comprises a second cylinder means for varying the spacing between said elevatory plate and said mask support plate.

4. Apparatus as claimed in claim 1, wherein said positioning and holding means includes a first positioning means having an engaging surface for engaging an inner surface of a first side wall of said panel and positioning said first side wall in a first direction substantially at a right angle to said first side wall, means for engaging an outer surface of said first side wall for pressing said first side wall against said engaging surface, a second positioning means having at least one engaging surface for engaging an inner surface of a second side wall of said panel located adjacent said first side wall and substantially at a right angle thereto and positioning said second side wall in a second direction substantially at a right angle to said second side wall, and means for engaging an outer surface of said second side wall for pressing said second side wall against said at least one engaging surface.

5. Apparatus as claimed in claim 4, wherein said first positioning means includes a sliding plate movable in said first direction, a positioning pawl substantially in the form of a latter L mounted on said sliding plate and having said engaging surface at one end and pivotally supported at the other end, means for moving said positioning pawl between a positioning or operative position in which said engaging surface is located within said panel and juxtaposed against the inner surface of said first side wall and a lower position in which said positioning pawl allows the shadow mask assembly to be moved downwardly from the panel, and means for moving said sliding plate between a positioning or operative position in which said engaging surface of said positioning pawl located in said operative position is brought to a predetermined position and a forward position in which said engaging surface is moved inwardly of the panel away from the predetermined position, and wherein said second positioning means includes a sliding plate movable in said second direction, a pair of positioning pawls substantially in the form of a letter L each having said engaging surface at one end and pivotally supported at the other end, means for moving said pair of positioning pawls between a positioning or operative position in which said engaging surfaces are located within said panel and juxtaposed against the inner surface of said second side wall and a lower position in which said positioning pawls allow the shadow mask assembly to be moved downwardly from the panel, and means for moving said sliding plate between a positioning or operative position in which the engaging surfaces of the positioning pawls located in said operative position are brought to predetermined positions and a forward position in which the engaging surfaces are moved inwardly of the panel away from the predetermined position.

6. Apparatus as claimed in claim 1, wherein said resilient plate bending means of said shadow mask assembly removing means comprises a rotary groove cam, four sliders connected at one end thereof to said rotary groove cam at a 90° spacing and each having an upright engaging pawl at the other end thereof, one of said engaging pawls being adapted to engage one side edge of the shadow mask assembly and the rest of the engaging pawls being adapted to engage the respective resilient plates of the shadow mask assembly, and guides for supporting said sliders for movement, said rotary groove cam being operative to move said sliders radially outwardly upon rotation in one direction and to move same in the reverse direction upon rotation in the opposite direction.

* * * * *